United States Patent [19]

Fenn, Jr et al.

[11] 3,970,844

[45] July 20, 1976

[54] DIRECT CHARGE READOUT ELECTRON-RADIOGRAPHY CHAMBER

[75] Inventors: John B. Fenn, Jr, Canoga Park; Murray S. Welkowsky, Sherman Oaks, both of Calif.

[73] Assignee: Xonics, Inc., Van Nuys, Calif.

[22] Filed: Jan. 7, 1975

[21] Appl. No.: 539,064

[52] U.S. Cl. ..... 250/213 VT; 250/315 A

[51] Int. Cl.[2] ..... H01J 31/50

[58] Field of Search ..... 250/315, 321, 213 R, 250/213 VT, 370; 315/10; 313/373, 374, 375; 178/6.8

[56] References Cited

UNITED STATES PATENTS

| | | | |
|---|---|---|---|
| 2,869,024 | 1/1959 | Bruining et al. | 315/10 |
| 2,945,973 | 7/1960 | Anderson | 313/373 |
| 3,436,550 | 4/1969 | Finkle | 250/213 VT |
| 3,495,084 | 2/1974 | Sheldon | 250/213 VT |
| 3,622,785 | 11/1971 | Irwin et al. | 250/213 VT |
| 3,668,396 | 6/1972 | Asars et al. | 178/6.8 |
| 3,890,506 | 6/1975 | Berninger | 250/370 |

*Primary Examiner*—Alfred E. Smith
*Assistant Examiner*—D. C. Nelms
*Attorney, Agent, or Firm*—Harris, Kern, Wallen & Tinsley

[57] ABSTRACT

A photo-optical imaging system suitable for use in an electronradiography system which produces an electrostatic charge image at an electrode. An electrode having a photoconductor layer and a transparent electrical conducting layer, with the charge image at the photoconductor layer. A light beam and various arrangements for scanning the beam over the photoconductor layer through the transparent layer for selectively transferring charge to the electrically conducting layer through the photoconductor layer as portions of the photoconductor layer are illuminated by the beam, and a data storage unit for receiving and storing data corresponding to the magnitude of charge at the photoconductor layer.

17 Claims, 10 Drawing Figures

DIRECT CHARGE READOUT ELECTRON-RADIOGRAPHY CHAMBER

BACKGROUND OF THE INVENTION

This invention relates to the creation of X-ray images without the use of conventional X-ray film and is particularly adapted for use with radiographic systems in which an X-ray source produces electrons and/or ions to form an electrostatic image suitable for printing. Such a system, commonly referred to as ionography or electron radiography, utilizes an X-ray opaque gas or liquid between two electrodes in an imaging chamber to produce a photoelectric current within that chamber which is a local function of the X-rays entering the chamber. The variation in the photocurrent due to the variation of X-ray intensity exiting from the illuminated object is commonly recorded on a dielectric sheet or receptor, and the latent electrostatic charge image is made visibly by xerographic techniques. For further information on the basic process, reference should be made to U.S. Pat. No. 3,774,029 entitled Radiographic System with Xerographic Printing.

The conventional electronradiographic system utilizes a gas at high pressure or a liquid at atmospheric pressure in the imaging chamber as an imaging medium. Because it is necessary to remove the receptor sheet from the imaging chamber for development of the latent electrostatic image, it is essential both from a financial and chemical purity standpoint that the imaging medium be removed and stored between exposures. This requires an imaging chamber which is easily accessible for the transport of the receptor, and a gas or liquid recycling system to preserve the imaging medium. The need for the transport of the receptor through the imaging chamber affects the design of the chamber, particularly with respect to strength and pressure sealing. Because of the relatively low static charge of the latent image, special liquid toners must be used, which require more complex handling than conventional liquid toners known in the art.

SUMMARY OF THE INVENTION

It is an object of the present invention to provide a new and improved apparatus for reading or measuring the static image charge generated in the chamber without requiring the use of a dielectric receptor within the chamber.

In the present invention, the charge generated in the imaging chamber is transmitted to external electronic logic by the use of an optically controlled gate, such as a photoconductor. The change in resistance of a photoconductor between its dark and light stages is used to store the generated charge and to conduct it to the external logic. This will allow the use of a permanently closed imaging chamber, resulting in a simplification of the general process and apparatus of the prior art described above. Other objects, advantages and features will become apparent in the course of the following description.

DESCRIPTION OF THE PREFERRED EMBODIMENTS

Figure 1:
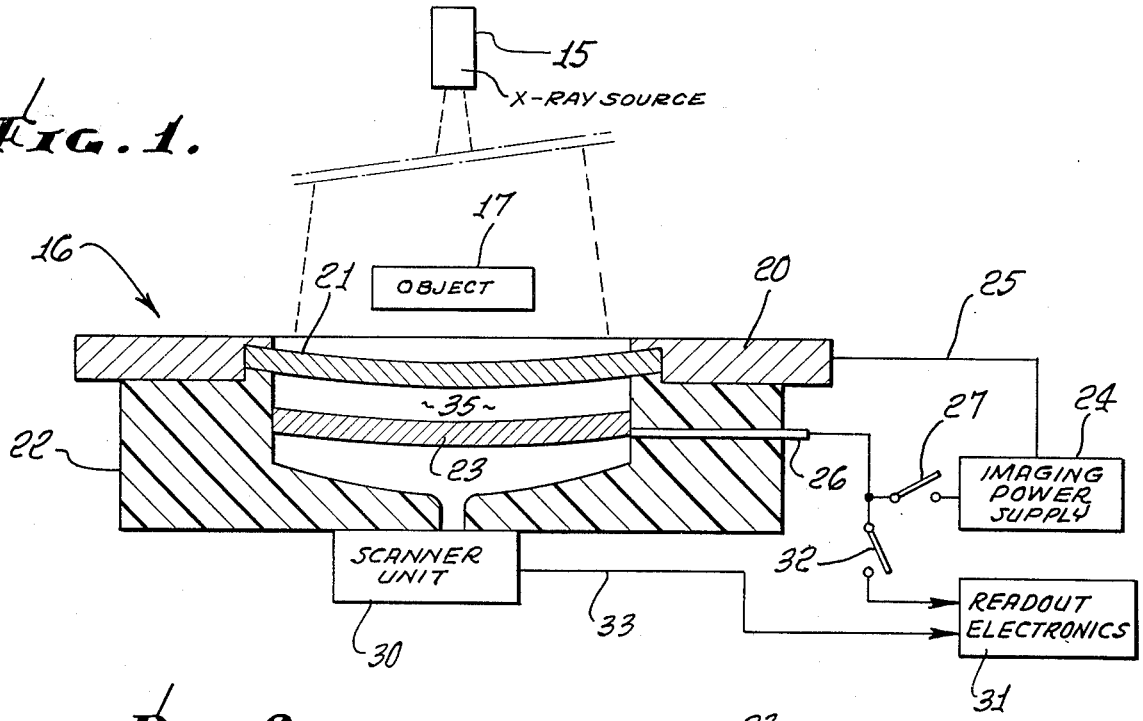
FIG. 1 is a diagramatic view of an electronradiography imaging chamber incorporating the presently preferred embodiment of the invention.

The system of FIG. 1 includes an X-ray source 15 and an imaging chamber 16, with an object 17 to be X-rayed positioned in front of the chamber. The chamber can be horizontal as shown, or vertical.

The imaging chamber 16 includes an upper housing member 20 carrying an electrode 21, and a lower housing member 22 carrying an electrode 23. An imaging power supply 24 is connected across the electrodes 21, 23 via line 25, line 26 and switch 27.

A beam of light is moved over the electrode 23 by a scanner indicated generally at 30, and several electrode and scanner configurations are described hereinbelow. The electrode 23 is connected to the readout electronics unit 31 via the line 26 and switch 32, and the scanner 30 is connected to the unit 31 via line 33.

A supply of an X-ray absorbing and electron and positive ion emitting medium is maintained in the gap 35 between the electrodes 21, 23. The medium may be a gas under high pressure as described in U.S. Pat. No. 3,774,029, or a liquid at atmospheric pressure as shown in U.S. Application, Ser. No. 456,532, filed Apr. 1, 1974 and assigned to the the same assignee as the present application. If the high pressure gas is utilized in the gap 35, a supply of gas at the same pressure may be provided in the areas surrounding the electrode 23 so that the pressure differential across the electrode is low.

The electrodes 21, 23 are shown as having uniformly spaced spherical surfaces at the gap 35, with the spherical center coinciding with the position of the X-ray source 15. This configuration is shown in U.S. Pat. No. 3,828,192. Alternatively, the electrodes may have uniformly spaced planar surfaces at the gap and reference may be had to U.S. application Ser. No. 388,212, filed Aug. 14, 1973, now U.S. Pat. No. 3,859,529 and assigned to the same assignee as the present application, for details of planar electrode configuration.

The electronradiography system of FIG. 1 is operated with a closed chamber, as opposed to the conventional system wherein the chamber including the gap 35 is opened to the ambient atmosphere between exposures in order to transport the dielectric receptor from the chamber to a developing station. Otherwise, the system of the present invention is operated in the usual manner to produce a latent electrostatic charge pattern or image on the gap surface of the electrode 23. The present invention is directed to the construction of the electrode 23 and apparatus for converting the electrostatic charge image to data for storage, transmission and/or reproduction.

Figure 2:
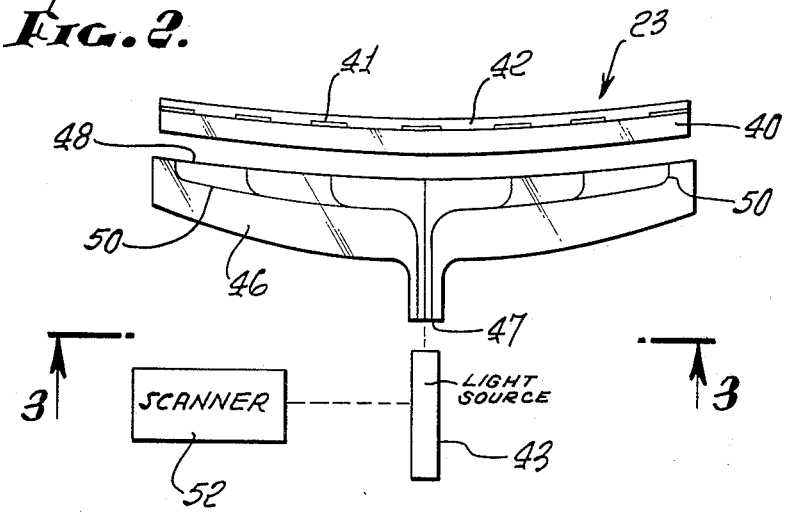
FIG. 2 is a view showing the lower electrode and scanning means of the instrument of FIG. 1 in greater detail.
Figure 3:
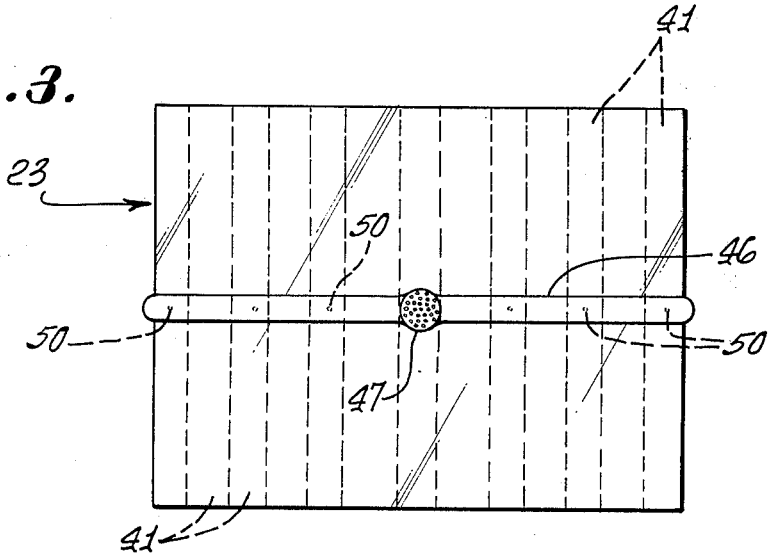
FIG. 3 is a view taken along a line 3—3 of FIG. 2.

Referring to FIGS. 2 and 3, the electrode 23 includes a transparent insulating substrate 40 for support purposes, with a layer of electrical conducting, optically transparent material in the form of a plurality of parallel strips 41. The strips may be formed of NESA glass or a thin metal layer, typically in the order of one thousandth of an inch thick and 2 to 8 thousandths of an inch wide. A photoconductor layer 42 is provided on the gap side of the electrode.

A light beam, typically from a laser source 43 is scanned over the electrode 23. A circle-to-line fiberoptic assembly 46 is positioned between the laser 43 and the electrode 23, with the circular face 47 receiving the beam from the laser 43, and with the line face 48 disposed transverse to the strips 41. The figures of the drawing show a few relatively large strips. However a typical imaging chamber will provide radiograph of 14 inch by 17 inch size with a resolution in the range of 5 to 10 line pairs per milimeter. Hence the actual apparatus will have a large number of small strips and it is understood that the figures of the drawings are for illustrative purposes.

In operation, an X-ray exposure is taken by energizing the source 15, with switch 32 open and switch 27 closed. When the exposure is completed, an electrostatic charge image is deposited on the gap surface of the photoconductor layer 42 of the electrode 23. The switch 27 is opened and the switch 32 is closed, connecting the readout electronic unit 31 to the strips 41. The laser 43 is turned on and light is conducted via fibers 50 in the assembly 46 to the photoconductor material of the layer 42 through the electrical conducting strips of the layer 41. The light changes the photoconductor material from a high resistance condition to a low resistance condition permitting transfer of the charge at the point illuminated by the light, through the photoconductor material to the electrical conducting material and thence to the readout electronics unit, that is the photoconductor material acts as a switch or gate which is actuated by the light beam so that the charge magnitude is transferred through the photoconductor material only when a zone of the material is illuminated by the light.

Data points on the electrode 23 are defined by the position of the assembly 46 and the strip 41 permitting the charge magnitude read out for a specific position of the assembly 46 and a specific strip to be stored with an *x–y* or other suitable address. The circle-to-line assembly 46 may be moved across the electrode 23 in a direction parallel to the strips 41 by a mechanical scanner 52 for reading the charge pattern over the entire electrode. In one embodiment, the circle-to-line fiberoptic assembly may be noncoherent, that is, the position of the face end of an individual fiber need not be related to the position of the line end of the fiber. The laser output may be continuous or pulsed. In an alternative arrangement, the circle-to-line assembly may be coherent, that is, the position of the face end of a fiber is related to the position of the line end so that a beam of light can be scanned across the face end for selectively illuminating points on the electrode. With this configuration, the layer 41 of electrical conducting material may be a continuous layer rather than a plurality of parallel strips. In the readout operation, the laser 43 is scanned across the assembly 46, preferably being pulsed to provide discrete readout positions, after which the assembly 46 is moved to provide a new line location for the laser scan. A resolution of five line pairs per milimeter calls for a laser beam spot size at the electrode about 4 thousandths of an inch in diameter, which is readily achieved with present day equipment.

Figure 4:
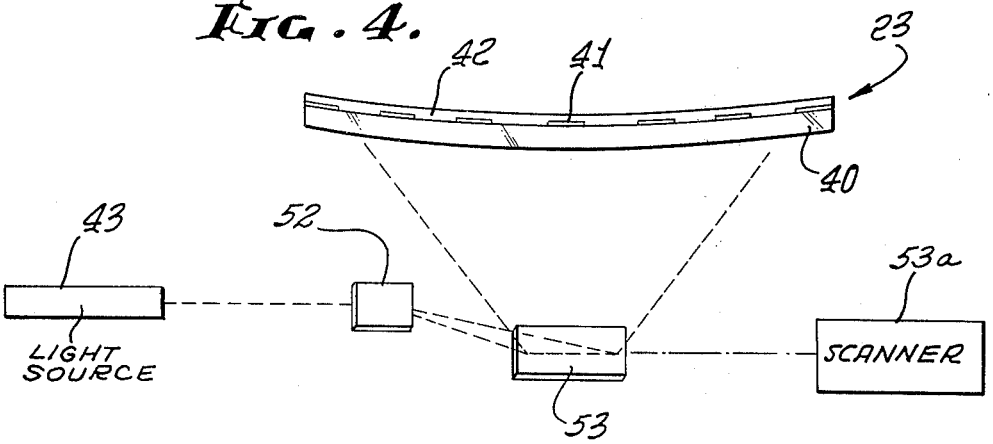
FIG. 4 is a view similar to that of FIG. 2 showing an alternative form of electrode and scanning means construction.

An alternative scanning configuration utilizing mirrors is shown in FIG. 4, where components corresponding to those of FIGS. 2 and 3 are identified by the same reference numerals. The laser beam is directed to a first mirror unit 52 which functions to convert the beam spot to a beam line at another mirror unit 53. This mirror unit 53 is then moved by a scanner 53*a* to move the line beam of light across the electrode 23, with the operation being the same as described in conjunction with the configuration of FIGS. 2 and 3. The laser output may be continuous or pulsed as desired.

Figure 5:
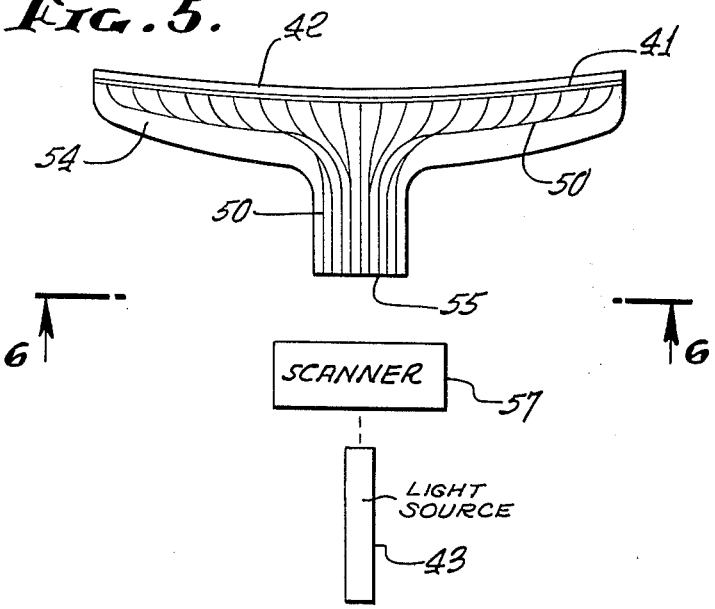
FIG. 5 is a view similar to that of FIG. 2 showing another alternative form of electrode and scanning means construction.
Figure 6:
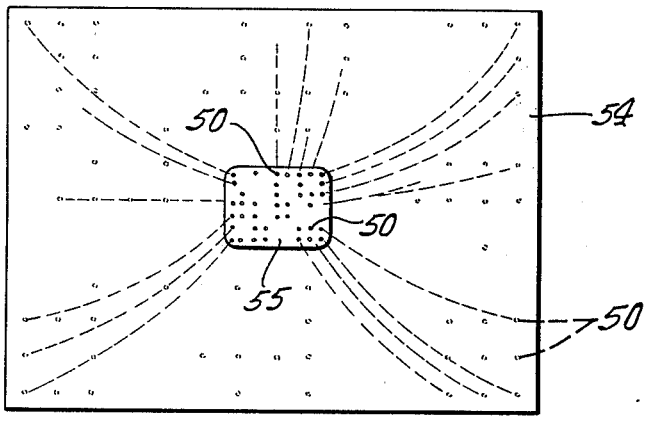
FIG. 6 is a view taken along a line 6—6 of FIG. 5.

Another alternative embodiment is shown in FIGS. 5 and 6, with a continuous electrical conducting, optically transparent layer 41 on a fiberoptic face plate 54 with the photoconductor layer 42 over the layer 41. The face plate 54 serves as the support for the layers 41, 42. The face plate is a coherent unit with a relatively small input face 55 and with the output face at the layers 41, 42 having the size of the electrode, with each individual fiber or fiber bundle 50 at the input face 55 providing for illumination of a predetermined point at the electrode. The beam from the laser 43 is scanned over the input face 55 by a scanner 57, typically in an *x–y* raster scan. The laser beam preferably is pulsed so that blurring and overlapping is eliminated. The use of the face plate allows scanning to be performed over a much smaller dimension, typically in the order of a few inches and this increases the accuracy of the scan and the definition of the location of the data point or resolution element on the photoconductor layer.

In an alternative configuration, the electrically conducting layer 41 can be made in the strip form as shown in FIGS. 2–4, permitting use of a line scan rather than a point by point raster scan thereby increasing the time that the photoconductor has to respond and permitting a wider selection of photoconductor materials.

A 14 inch by 17 inch radiograph with a resolution of five line pairs per milimeter would require about $4 \times 10^6$ data points when an *x–y* raster scan is utilized, the on-off response time of the photoconductor material at each data point must be in the order of a few microseconds for a readout time of several seconds. Otherwise there will be image blurring by overlapping of successive points. When a line scan is used in place of the raster scan, the time for response by the photoconductor material is increased by a factor of 4,000.

Figure 10:
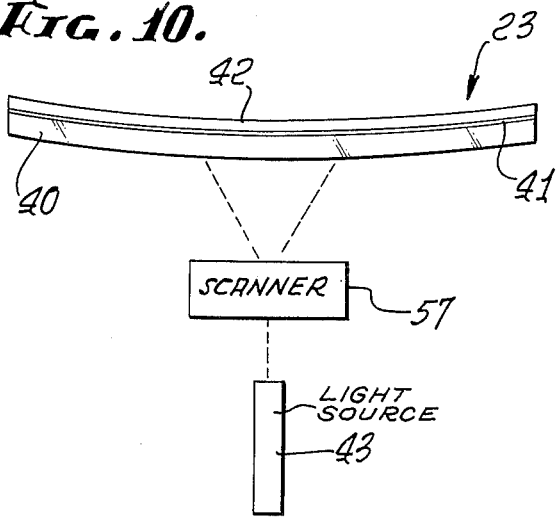
FIG. 10 is a view similar to that of FIG. 7 showing another form of electrode construction.

The fiber optic face plate assembly 54 may be omitted, with the laser beam being scanned directly over the entire surface of the electrode, and such a configuration is shown in FIG. 10. This configuration eliminates the cost of the face plate, but requires considerably greater magnitude of scan and ordinarily would be preferred only for relatively small imaging chambers.

Figure 7:
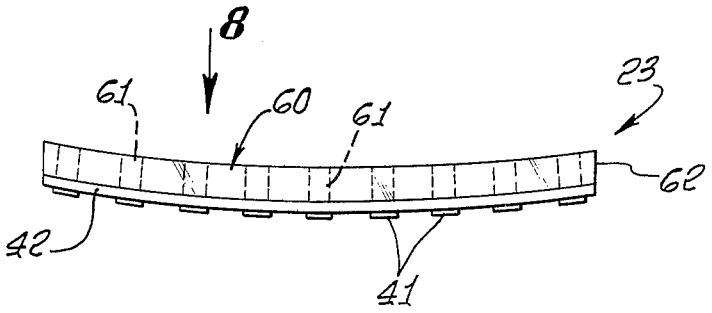
FIG. 7 is a view showing an alternative form of lower electrode construction.
Figure 8:
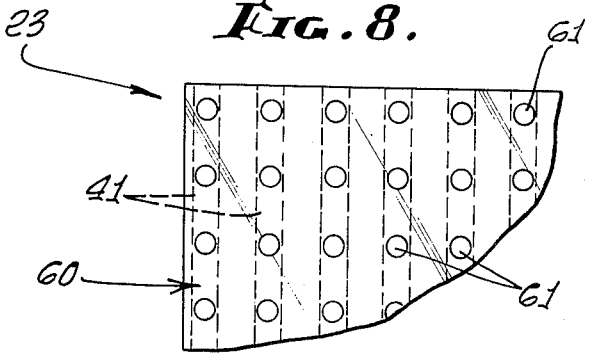
FIG. 8 is a partial view of the electrode of FIG. 7 taken along the arrow 8.

When used with an X-ray source, it is desirable that the photoconductor material be a non-X-ray absorbing material so that those X-rays reaching the photoconductor will not cause an increase in its conductivity, either through its bulk or laterally along its surface. Such an occurrence would cause image degradation. Alternatively, a layer of an X-ray absorbing material can be positioned at the gap surface of the photoconductor. This layer should be anisotropic so that the charge image is transferred through the layer to the photoconductor. A preferred embodiment of this configuration is shown in FIGS. 7 and 8 wherein the photoconductor 42 is carried on an anisotropic plate 60, with the electrically conducting layer 41 on the photoconductor layer 42. The plate 60 may comprise a plurality of electrically conducting pins 61 in a glass support 62, with the pins providing conductive paths from the gap surface to the photoconductor layer. The pins 61 may be made of a metal which is highly X-ray absorbing and the glass 62 may be a lead glass which is highly X-ray absorbing.

It will readily be seen that the plate 60 with the pin matrix can be utilized with the conducting layer 41 in the strip form and also in the continuous form. The pin matrix configuration permits the use of a continuous beam of light in the $x$–$y$ or raster scan rather than a pulsed beam.

Figure 9:
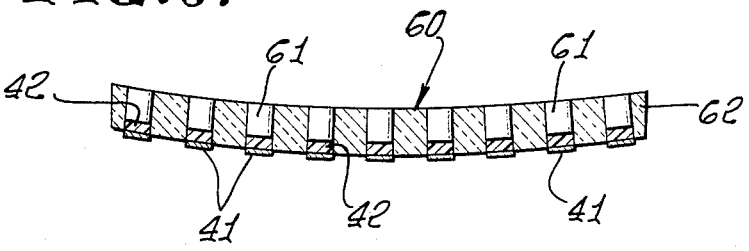
FIG. 9 is a view similar to that of FIG. 7 showing another alternative form of electrode construction.

A variation of the structure of FIGS. 7 and 8 is shown in FIG. 9, with the pins 61 terminating short of the lower face of the plate 60 and with the photoconductor layer 42 positioned in the holes in alignment with the pins. The electrical conducting layer 41 may be continuous or in strips as desired, depending upon the type of scan and readout utilized.

Reconstruction of the X-ray generated image can be handled in a variety of ways. It is to be assumed in the following discussion that the signal readout from the photoconductor and referred to as the readout signal, can be properly amplified to the level required by any of the following methods. The initial value of the voltage being read out will be of the order of one tenth of a volt. Listed below are several different methods which can be considered. This list is not meant to be complete, and other printing systems known to those well versed in the art are assumed to be covered by the spirit of this disclosure.

The number of data points being considered is of the order of $4 \times 10^6$, if a 14 inches × 17 inches image, normally the largest image size considered, is scanned with a resolution limit of 5 lp/mm at 100% MTF (modulation transfer function). If 100 seconds are allowed for recording and reconstruction of the X-ray image and this time is shared equally for each point, then each data bit must be processed in 20 microseconds, a rate which is well within the state of the art which exists today. This time can be increased if data points are handled simultaneously, as mentioned earlier. Other X-ray shots are smaller than the 14 inches × 17 inches shot being considered, making it correspondingly simpler to process them.

If computer techniques are to be incorporated then reconstruction is done subsequently to the readout step. Once the data has been manipulated, it can be left in storage and be recalled at the operator's request. Most of the methods of constructing a visual image will be the same whether this image is produced simultaneously with, or subsequent to the readout step. Therefore it will be assumed that the methods described below apply to both types of data handling unless otherwise stated. Several of these methods are given below.

The simplest concept is to use a laser in a raster scan mode. This can be used in conjunction with a computer stored image or one that is being read out in a raster scan. The receptor or film can be anything that is sensitive to laser light such as normal silver halide film, dry silver film, or polyester film coated with an organic transparent photoconductor. The image is reproduced by using the readout signal to modulate the intensity of the laser beam. Gray scale is achieved by the variation of the readout signal, which is proportional to the amount of X-rays absorbed in the imaging chamber.

The modulating system may be conventional. Scanning of the write beam can be accomplished by either mechanical or electro-optical methods which are currently in the state of the art.

An alternative method for image formation would be to use a fiber optic CRT line scan tube. In this configuration the CRT is driven by the readout signal. The film is driven past the linear scan tube to record the image. Again the film or receptor can be anything that ia sensitive to the CRT phosphor output. This system is compatible with a computer controlled memory system or a simultaneously occurring raster readout system. Gray scale is achieved by the intensity of the CRT tube or by the dot density generated per unit area.

Another alternative method that is compatible with the line scan readout method is to use a fiber optic line scan plate which is illuminated by a continuous light source. Incorporated in this system are individual modulating stations, the number needed corresponding to the number of simultaneous output channels used in the readout design. Each output channel drives its corresponding modulator such that a one to one correspondence of voltage vs. light intensity is achieved. Any of the methods of light modulation known to those well versed in the art can be used.

While the invention has been described above utilizing an X-ray source for producing the electrostatic charge image on the electrode 23, it should be understood that the invention is also applicable to other systems utilizing electromagnetic radiation sources for the generation of electrostatic charge images through the ionization of an absorbing medium. As used herein, the adjective "optically" means that the material responds to electromagnetic radiation of the wavelength emitted by the incident light source, such as the laser described in the application. The spectrum of this radiation may extend from the ultraviolet to the infrared.

We claim:

1. In a system for readout of an electrostatic charge pattern and having an electrode and means for forming an electrostatic charge image on said electrode, the improvement wherein said electrode includes a first photoconductor layer for receiving the electrostatic charge and being selectively switchable from a first electrical non-conducting state to a second electrical conducting state by exposure to light, with said first layer returning to said first state when light exposure is discontinued, and a second electrical conducting, optically transparent layer, and including:

means for scanning a photoconductor switching light beam over said first layer through said second layer; and means connecting said second layer to storage means for storing data corresponding to the magnitude of charge at points on said electrode which charge is selectively transferred to said second layer through said first layer as said first layer is illuminated by said light beam and switched to said second conducting state.

2. A system as defined in claim 1 wherein said means for scanning includes:

means for pulsing the light beam; and means for moving the pulsed beam over said first layer in a plurality of parallel lines.

3. A system as defined in claim 2 wherein said second layer is a continuous layer.

4. A system as defined in claim 1 wherein said means for scanning includes:

a circle-to-line fiberoptic assembly having a generally circular input face and a linear output face for light transmission from the input face to the output face;

means for directing a light beam to said input face; and means for moving said output face across said second layer.

5. A system as defined in claim 4 wherein said second layer comprises a plurality of parallel strips.

6. A system as defined in claim 4 wherein said second layer is a continuous layer, and including means for directing the light beam to individual fibers at said input face to scan the beam across said output face.

7. A system as defined in claim 4 wherein said second layer is a continuous layer, and including means for pulsing the light beam.

8. A system as defined in claim 1 wherein said scanning means includes:

first and second mirror means, said first mirror means including means for converting a light beam spot into a light beam line at said second mirror means, said second mirror means including means for directing the light beam line to said first layer; and means for moving said line across said first layer.

9. A system as defined in claim 8 wherein said second layer is a continuous layer, and including means for pulsing the light beam.

10. A system as defined in claim 8 wherein said second layer comprises a plurality of parallel strips.

11. A system as defined in claim 1 wherein said scanning means includes:

a fiberoptic assembly having an output face overlying said second layer and an input face substantially smaller than said output face for light transmission along fibers from points on said input face to corresponding points on said output face; and means for moving the light beam at said input face.

12. A system as defined in claim 11 wherein said second layer is a continuous layer.

13. A system as defined in claim 11 wherein said second layer comprises a plurality of strips and said fiberoptic assembly includes a plurality of circle-to-line subassemblies.

14. A system as defined in claim 1 wherein said electrode includes an anisotropic conductive plate with said first layer at said plate.

15. A system as defined in claim 14 wherein said plate comprises a plurality of electrical conductors in an electrical insulating support.

16. A system as defined in claim 15 with said electrical conductors arranged in columns and with said second layer comprising a plurality of strips aligned with said columns.

17. A system as defined in claim 15 with said first layer comprising a plurality of spots in line with said electrical conductors of said plate.

* * * * *